US011329388B2

(12) United States Patent
Lerosey et al.

(10) Patent No.: US 11,329,388 B2
(45) Date of Patent: May 10, 2022

(54) ANTENNA FOR TRANSMITTING AND/OR RECEIVING AN ELECTROMAGNETIC WAVE, AND SYSTEM COMPRISING THIS ANTENNA

(71) Applicants: GREENERWAVE, Valbonne (FR); CENTRE NATIONAL DE LA RECHERCHE SCIENTIFIQUE—CNRS, Paris (FR); ECOLE SUPÉRIEURE DE PHYSIQUE ET DE CHIMIE INDUSTRIELLES DE LA VILLE DE PARIS, Paris (FR)

(72) Inventors: Geoffroy Lerosey, Paris (FR); Mathias Fink, Meudon (FR); Philipp Del Hougne, Paris (FR); Jean-Baptiste Gros, Paris (FR)

(73) Assignees: GREENERWAVE, Valbonne (FR); CENTRE NATIONAL DE LA RECHERCHE SCIENTIFIQUE—CNRS, Paris (FR); ECOLE SUPÉRIEURE DE PHYSIQUE ET DE CHIMIE INDUSTRIELLES DE LA VILLE DE PARIS, Paris (FR)

( * ) Notice: Subject to any disclaimer, the term of this patent is extended or adjusted under 35 U.S.C. 154(b) by 0 days.

(21) Appl. No.: 17/264,120

(22) PCT Filed: Aug. 23, 2019

(86) PCT No.: PCT/EP2019/072637
§ 371 (c)(1),
(2) Date: Jan. 28, 2021

(87) PCT Pub. No.: WO2020/043632
PCT Pub. Date: Mar. 5, 2020

(65) Prior Publication Data

US 2021/0313701 A1 Oct. 7, 2021

(30) Foreign Application Priority Data

Aug. 27, 2018 (FR) ..... 1857669

(51) Int. Cl.
*H01Q 15/00* (2006.01)
*H01Q 1/42* (2006.01)
(Continued)

(52) U.S. Cl.
CPC ..... *H01Q 15/0066* (2013.01); *H01Q 1/42* (2013.01); *H01Q 3/46* (2013.01); *H01Q 13/18* (2013.01)

(58) Field of Classification Search
CPC ..... H01Q 1/42; H01Q 3/44; H01Q 3/443; H01Q 3/446; H01Q 3/46; H01Q 13/18;
(Continued)

(56) References Cited

U.S. PATENT DOCUMENTS

2004/0263408 A1 12/2004 Sievenpiper et al.
2013/0201068 A1 8/2013 Alexopoulos et al.
(Continued)

FOREIGN PATENT DOCUMENTS

FR 3 054 940 2/2018
FR 3 056 044 3/2018

OTHER PUBLICATIONS

International Search Report for PCT/EP2019/072637 dated Dec. 13, 2019, 7 pages.
(Continued)

*Primary Examiner* — Robert Karacsony
(74) *Attorney, Agent, or Firm* — Nixon & Vanderhye

(57) ABSTRACT

Antenna for transmitting and/or receiving an electromagnetic wave, including a radiating element, a tunable surface of variable impedance, and a controller connected to the tunable surface and which controls it based on a desired
(Continued)

direction of the electromagnetic wave. The radiating element and the tunable surface are integrated inside a housing, the housing forming a cavity for the waves and including an opening for the electromagnetic wave to be transmitted to the outside.

26 Claims, 4 Drawing Sheets

(51) Int. Cl.
*H01Q 3/46* (2006.01)
*H01Q 13/18* (2006.01)

(58) Field of Classification Search
CPC ..... H01Q 13/20; H01Q 13/22; H01Q 13/28; H01Q 15/0006; H01Q 15/0013; H01Q 15/002; H01Q 15/006; H01Q 15/0066; H01Q 15/008; H01Q 15/0086; H01Q 15/0093
See application file for complete search history.

(56) References Cited

U.S. PATENT DOCUMENTS

| | | | | |
|---|---|---|---|---|
| 2015/0130673 | A1 | 5/2015 | Ng et al. | |
| 2016/0233971 | A1 | 8/2016 | Fink et al. | |
| 2017/0133762 | A1* | 5/2017 | Ng | H01Q 1/12 |
| 2017/0352952 | A1 | 12/2017 | Weiler et al. | |
| 2018/0076521 | A1 | 3/2018 | Mehdipour et al. | |

OTHER PUBLICATIONS

Written Opinion of the ISA for PCT/EP2019/072637 dated Dec. 13, 2019, 8 pages.
Search Report for 1857669 dated Jul. 4, 2019, 2 pages.
Sleasman et al., "Microwave Imaging Using a Disordered Cavity with a Dynamically Tunable Impedance Surface", Physical Review Applied, vol. 6, Issue 5, Nov. 2016, Article No. 054019, (10 pages).

* cited by examiner

FIG. 1
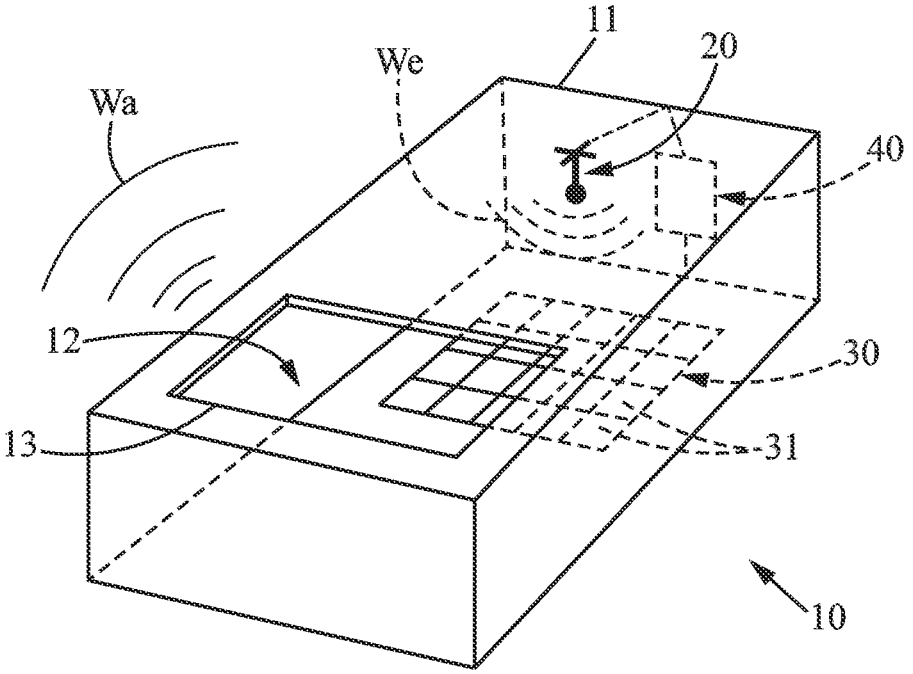
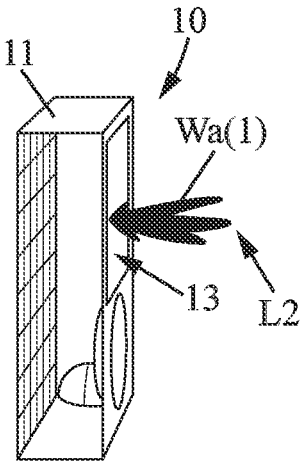
FIG. 2a
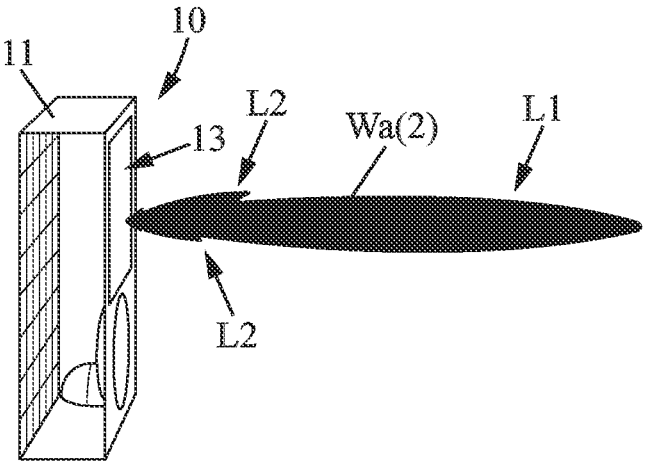
FIG. 2b

ANTENNA FOR TRANSMITTING AND/OR RECEIVING AN ELECTROMAGNETIC WAVE, AND SYSTEM COMPRISING THIS ANTENNA

CROSS-REFERENCE TO RELATED APPLICATIONS

This application is the U.S. national phase of International Application No. PCT/EP2019/072637 filed Aug. 23, 2019 which designated the U.S. and claims priority to FR 1857669 filed Aug. 27, 2018, the entire contents of each of which are hereby incorporated by reference.

TECHNICAL FIELD

The present invention relates to antennas for transmitting and/or receiving an electromagnetic wave in a desired direction. These antennas are said to be of the directional type, meaning they transmit and/or receive an electromagnetic wave beam, it being possible to direct the orientation of this beam.

PRIOR ART

More particularly, the invention relates to an antenna comprising:

- a radiating element for emitting and/or receiving said electromagnetic wave,
- an tunable surface comprising a plurality of elements that are adjustable in order to modify an impedance of said tunable surface and to change the manner in which the electromagnetic wave is reflected by said tunable surface, and
- a controller connected to the tunable surface and which controls the adjustable elements thereof based on parameters, said parameters being determined based on the desired direction of the electromagnetic wave.

An antenna is isotropic if it transmits and/or receives an electromagnetic wave in the same manner in all directions. An antenna has directivity if it transmits and/or receives an electromagnetic wave in a specific direction. These directional antennas are characterized by a radiation pattern, i.e. the amplitude of the electromagnetic wave as a function of the direction in a horizontal plane and/or vertical plane. Such a radiation pattern is generally established in relation to an angle in each plane; it is therefore a polar curve that represents the amplitude of the wave as a function of the angle between 0° and 360°. This curve generally includes maxima called lobes which are angular directions in which the antenna transmits more or receives more (is more sensitive). An antenna is therefore directional if its radiation pattern has a main lobe of large amplitude in a determined direction, and other side lobes of smaller amplitude than that of the main lobe.

Many techniques exist for controlling the direction of a directional antenna.

For example, there are antennas of the phased array type which are composed of an array of radiating elements, the phase and amplitude of each one being controlled in order to generate an overall directional radiation in a steerable direction.

In this type of antenna, the radiating elements are numerous and each is connected to a controlled amplifier. The antenna is complex and consumes a lot of energy.

For example, there are antennas of the "reflectarray" type, such as the antenna in document US 2004/263408 which uses a radiating element of the feed horn type, known to have a directional radiation pattern focused in one direction, and a tunable surface positioned in front of the feed horn to reflect the electromagnetic wave in a direction determined by the states of the adjustable elements of the tunable surface.

The radiating element (feed horn) has a main lobe of a fixed radiation direction, but by changing the states of the adjustable elements, the antenna controller changes the amplitude and/or phase of the wave reflected by each adjustable element of the tunable surface, and thus changes the direction of the reflected electromagnetic wave. The tunable surface therefore makes it possible to tilt the main lobe generated by the radiating element.

In this type of antenna, the tunable surface is positioned at a distance from the radiating element. The antenna is then generally very bulky (not very compact) and has a limited spatial range of radiation because the tunable surface generates a large shadowed area.

DISCLOSURE OF THE INVENTION

The present invention aims to improve steerable beam antennas.

For this purpose, the antenna of the above type is characterized in that the radiating element and the tunable surface are integrated inside a housing, said housing forming a cavity adapted so that the electromagnetic wave is reflected several times inside the housing in order to strike the adjustable elements of the tunable surface several times, and said housing comprising an opening for the electromagnetic wave to be transmitted to outside the housing or be received from outside the housing, through said opening, and to/from the far field.

With these arrangements, the electromagnetic wave generated by the radiating element is reflected several times inside the cavity and by the tunable surface before being emitted via the opening (direct or semi-reflective opening) to outside the housing. This electromagnetic wave is then more easily controllable before its far-field transmission. In particular, it is possible to create, simultaneously and with any type of radiating element, a directional antenna with a main lobe of large amplitude and tiltable in any direction.

In addition, losses of electromagnetic radiation outside the tunable surface are avoided. The wave emitted by the radiating element is almost completely reflected by the tunable surface, and therefore almost all of the emitted wave can be controlled to be concentrated into a single beam, i.e. a high-energy main lobe. The antenna is therefore more efficient.

In addition, all the paths between the radiating element and the tunable surface are contained within the volume of the cavity, i.e. inside the housing, and the antenna is more compact.

Finally, the adjustable elements of the tunable surface can be distributed in any manner within the cavity, because the multiple reflections ensure a sweep of the inner surface of the housing and thus all adjustable elements are reached.

In various embodiments of the antenna according to the invention, one or more of the following arrangements may possibly be used:

According to one aspect, a screen is positioned in the cavity between the radiating element and the opening, to limit direct radiation of the electromagnetic wave from the radiating element to outside the housing and/or to reflect the waves towards the tunable surface.

According to one aspect, the opening consists of several elementary openings, these elementary openings being on one face of the housing or on a plurality of faces of the housing.

According to one aspect, the opening at least partially consists of one or more semi-reflective elements.

According to one aspect, the semi-reflective element is implemented by a thin metal film.

According to one aspect, the semi-reflective element is implemented by a network of holes in a metal element or a network of metal shapes, a hole or shape being distanced from a neighboring one by a distance that is less than half the wavelength of the electromagnetic wave.

According to one aspect, the semi-reflective element has an electromagnetic transmission property which varies within the surface of the opening.

According to one aspect, the electromagnetic transmission property comprises the transmission amplitude and/or the transmission phase.

According to one aspect, the semi-reflective element comprises one or more adjustable opening elements in order to change the manner in which the electromagnetic wave is reflected and/or transmitted by said opening, the controller being linked to the adjustable opening elements in order to control them based on opening parameters.

According to one aspect, the radiating element is positioned in the housing so as to emit and/or receive an electromagnetic wave primarily directly towards the tunable surface, by orientation of said element within the housing.

According to one aspect, the radiating element is impedance matched with the impedance of the cavity, in order to satisfy a critical coupling condition.

According to one aspect, the radiating element is selected from a list comprising a monopole, a dipole, a waveguide, a radiating waveguide, and a planar antenna.

According to one aspect, the tunable surface covers all the inside faces of the housing or a portion of the inside faces of the housing or one or more of the inside faces of the housing.

According to one aspect, the tunable surface consists of adjustable elements distributed within the housing without periodicity.

According to one aspect, the tunable surface comprises first adjustable elements tuned to a first frequency and second adjustable elements tuned to a second frequency, the first frequency being different from the second frequency.

According to one aspect, the first and second adjustable elements are distributed are spatially intermixed.

According to one aspect, the tunable surface comprises adjustable elements tuned to a plurality of different frequencies within a predetermined bandwidth.

According to one aspect, the housing comprises a main face, and the housing has a thickness dimension in a direction perpendicular to said main face that is smaller than the other dimensions of the housing, and the thickness dimension is greater than half the wavelength of the electromagnetic wave.

According to one aspect, the housing comprises a main face, and the main face is semi-spherical in shape.

According to one aspect, the controller determines the parameters also as a function of a desired polarization.

According to one aspect, the controller determines the parameters based on parameter values previously stored in a memory, or by calculating a model, or by an iterative process using additional information.

According to one aspect, the additional information is obtained from signals from external sensors located outside the housing and capable of receiving the electromagnetic wave.

According to one aspect, the antenna further comprises one or more internal sensors capable of receiving the electromagnetic wave, said internal sensors being integrated inside the housing, and the controller determines the parameters based on a desired direction of the electromagnetic wave and on values of the electromagnetic wave received by the internal sensors at certain predetermined periods.

According to one aspect, the antenna comprises a plurality of radiating elements integrated inside the housing.

The invention also relates to a radio communication system capable of communicating communications of audio, video, messages, or data. This radio communication system comprises an antenna as presented above.

The invention also relates to a radar detection system suitable for locating objects within a space. This radar detection system comprises an antenna as presented above.

BRIEF DESCRIPTION OF DRAWINGS

Other features and advantages of the invention will become apparent from the following description of one of its embodiments, given as a non-limiting example, with reference to the accompanying drawings.

In the drawings:

FIG. 1 is a schematic view of a first embodiment of an antenna according to the invention, FIG. 2*a* shows radiation from the antenna of FIG. 1, without optimization of parameters, FIG. 2*b* shows radiation from the antenna of FIG. 1, after optimization of parameters by the controller.

DETAILED DESCRIPTION

Figure 3A:
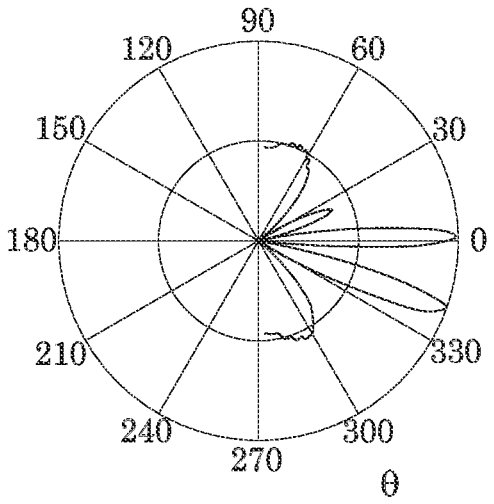
FIG. 3*a* is a radiation pattern of the antenna of FIG. 1, without optimization of parameters.

FIG. 1 shows a first embodiment of the invention of an antenna 10 according to the invention. The antenna 10 is an antenna for transmitting and/or receiving an electromagnetic wave in a desired direction.

The antenna 10 comprises:

- a radiating element 20 for emitting and/or receiving the electromagnetic wave,
- a tunable surface 30 comprising a plurality of elements 31 that are adjustable in order to modify an impedance of the tunable surface and to change the manner in which the electromagnetic wave is reflected and/or transmitted by said tunable surface, and a controller 40 connected to the tunable surface and which controls the adjustable elements thereof based on parameters, the parameters being determined based on the desired direction of the electromagnetic wave.

Such an antenna may be used for example in:

a radio communication system capable of communicating communications of audio, video, messages, or data, or in a radar detection system capable of locating objects within a space.

Variants of known tunable surfaces are described for example in the document US 2004/263408 cited above or in document US 2016/0233971. Many techniques are known for implementing such tunable surfaces, sometimes called tunable impedance surfaces, meta-surfaces, waveform shaping devices, or reflectarrays.

For the antenna 10 according to the invention, the radiating element 20 and the tunable surface 30 are integrated inside a housing 11, often called a "radome" in this technical field. However, here, not only does the housing serve to protect the antenna, but the housing 11 forms a cavity 12 (an electromagnetic cavity) for the waves We emitted and/received by the radiating element 20. The housing 11 is thus adapted so that these waves We are reflected one or more times inside the housing and possibly reflected one or more times by adjustable elements 31 of the tunable surface 30.

For example, the housing 11 is made of a material transparent to electromagnetic waves and its inner surface is at least partially metallized or covered with a metal layer (metallized) suitable for reflecting the waves We emitted by the radiating element 20.

More generally, the housing 11 comprises a means for reflecting the waves We one or more times inside the housing so that these waves strike the adjustable elements 31 of the tunable surface 30 one or more times. Due to these multiple reflections on adjustable elements, these waves are controllable with a wide variety of settings.

Furthermore, the housing 11 is a 3-dimensional enclosure which temporarily encloses the waves We. This enclosure has for example a parallelepipedal shape which comprises for example a lower face, an upper face, and side faces. These faces comprise said means for reflecting the waves.

Alternatively, the housing 11 has a semi-spherical or spherical shape.

For example, the faces or surfaces of the housing 11 are covered with a suitable material so that the wave We emitted and/or received by the radiating element 20 is reflected by the faces of this 3-dimensional housing 11. The suitable material is for example a metal or metallized material or one loaded with metal particles.

The housing 11 comprises an opening 13 for emitting the electromagnetic wave We to outside the housing or for receiving it from outside the housing 11, through this opening 13, as an electromagnetic wave Wa propagating externally. Once emitted from the housing 11, this electromagnetic wave Wa emitted by the antenna 10 then propagates to the far field. Conversely, the housing 11 behaves like a sensor which, through the opening 13, absorbs electromagnetic waves Wa coming from the far field so that the radiating element 20 in the housing receives a large amount of waves We inside the cavity.

This opening 13 is an opening in the electromagnetic sense: the housing 11 may be physically closed and sealed, but there is an electromagnetic opening 13 which allows an at least partial leakage of electromagnetic waves to outside the housing. It is sufficient, for example, for a portion of a housing not to be metallized.

The antenna 10 according to the invention therefore consists of an electromagnetic cavity defined by a housing 11 in which is located a tunable surface 30 of controllable property, and a radiating element 20 which is a source oriented towards the tunable surface 20 and which is screened from the outside of the housing 11 by a metal interface.

Note that the tunable surface 30 is not positioned in the opening 13, as this would reduce the performance and controllability of the antenna 10, but is positioned on one or more internal walls of the housing 11.

Due to this integration of a radiating element 20 and a tunable surface 30 in an electromagnetic cavity, the antenna 10 is able to transform any electromagnetic radiation from the radiating element simultaneously into directional radiation (focused in one direction) and a radiation of controllable tilt (orientation) in all spatial directions. In addition, this antenna is compact and very efficient.

In addition, unlike prior techniques with phase array or reflectarray antennas, which impose fixed distances between the adjustable elements due to their operating principles, the adjustable elements 31 of the tunable surface can be distributed in any manner whatsoever within the cavity 12. Indeed, the multiple reflections within the cavity 12 ensure that the entire inner surface of the housing 11 is swept and therefore all adjustable elements 31 are reached.

The parameters make it possible to determine the states of each adjustable element 31 of the tunable surface 30, in other words the manner in which each one modifies its impedance and in which the electromagnetic wave We is reflected and/or transmitted in the cavity 12. A set of parameters determines all of these states and therefore the characteristics of the antenna.

It is possible to find a set of parameters which optimizes the transmission and/or reception (by reciprocity) of the electromagnetic wave Wa of the antenna, in other words which makes it possible to obtain a main lobe L1 of large amplitude and side lobes L2 of low amplitude, as represented in FIGS. 2*a* and 2*b* which show the change between an emission beam for a set of non-optimized parameters (FIG. 2*a*) then for a set of optimized parameters (FIG. 2*b*). In the optimized mode, the side lobes L2 have an amplitude that is less than half the amplitude of the main lobe L1. Preferably, the antenna will be designed to obtain side lobe L2 amplitudes that are less than ¼ of the amplitude of the main lobe L1. Ideally, one could seek to obtain a ratio of 1/10 for these amplitudes.

A highly efficient directional antenna (beam concentrated in one direction) is thus obtained, and in particular from any type of radiating element, not just a horn as presented in document US 2004/263408.

Figure 3B:
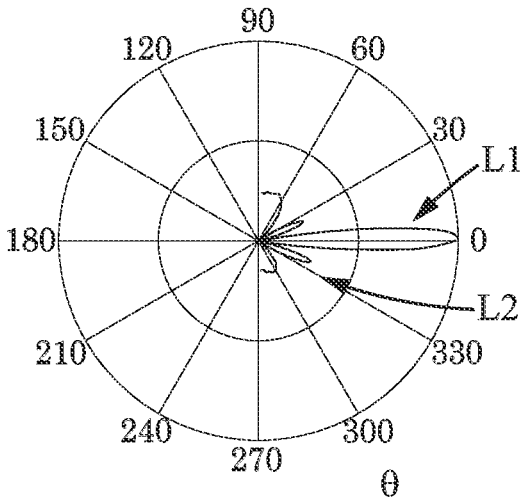
FIG. 3*b* is a radiation pattern of the antenna of FIG. 1, after optimization of parameters by the controller.

FIGS. 3*a* and 3*b* show normalized radiation patterns at amplitude 1 of the antenna 10 with the parameters of FIGS. 3*a* and 3*b* respectively. These patterns show that changing the parameters makes it possible to improve the directivity of the antenna 10, since in the first set of parameters the pattern has two lobes of almost the same amplitude (FIG. 3*a*), while in the second set of parameters (optimized), the pattern shows a main lobe of large amplitude at the angular position of 0° (FIG. 3*b*). This main lobe does indeed have an amplitude greater than 4 times the amplitude of the other lobes, the side lobes.

Figure 4A:
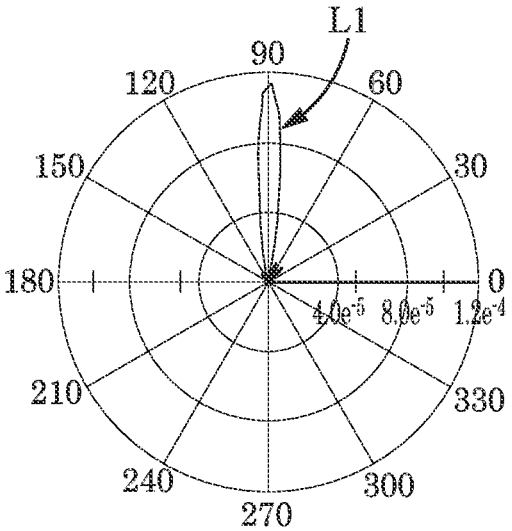
FIG. 4*a* is another radiation pattern of the antenna of FIG. 1, with parameters optimized to transmit at an angle of 90°.
Figure 4B:
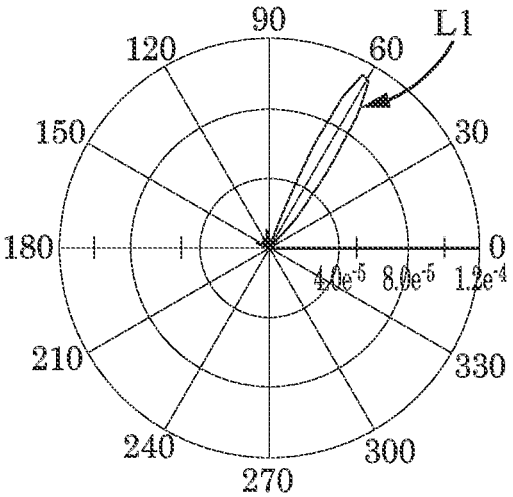
FIG. 4*b* is another radiation pattern of the antenna of FIG. 1, with parameters optimized to transmit at an angle of 60°.

Next, it is also possible to find a set of parameters which changes the orientation of the main lobe L1 of the antenna 10. Indeed, we are looking for a set of parameters that is directivity-optimized for each orientation or direction, as shown in FIGS. 4*a* and 4*b*. FIG. 4*a* shows a radiation pattern optimized for an orientation or direction of 90°, and FIG. 4*b* shows a radiation pattern optimized for an orientation or direction of 60°. The inventors have found for the antenna 10 created that it is possible to obtain sets of parameters optimized for a wide range of angles of transmission/reception. For example, this range of angles is about +/−60° relative to a direction normal to the opening, this being the case in the two perpendicular planes, i.e. the horizontal plane and the vertical plane.

In a simple manner we thus obtain an antenna of adjustable radiation orientation that is highly efficient (sensitivity).

The controller 40 can determine the parameters for the tunable surface 30 according to the desired direction of the electromagnetic wave Wa for the antenna 10.

With the above explanations, it is understood that it will be possible to store values of sets of parameters in the controller's memory for a plurality of directions, for example a set of pairs of angular directions according to an angle of the horizontal plane (azimuth) and an angle of the vertical plane (elevation). For example, the controller will choose the set of parameters whose direction is closest to the desired direction. Optionally, the controller will be able to interpolate between several sets of parameters of neighboring directions.

Alternatively, a model of the sets of parameters could be established, and the controller 40 will determine the parameters by calculations with this model and the desired direction.

Alternatively, the controller 40 will determine the set of parameters to be used by an iterative method of optimization, the optimization being for example carried out with the aid of additional information given to the controller. This additional information may come from signals from one or more external sensors connected to said controller 40 by a direct or indirect, wired or wireless link. Optionally, this additional information may come from another system, for example a system that uses the antenna 10. This additional information relates to the electromagnetic wave Wa transmitted and/or received by the antenna 10, in the near field of the antenna and/or far field of the antenna.

In particular, this additional information can serve as feedback information for determining the adjustment parameters of the tunable surface 30.

The antenna 10 according to the embodiment presented above can then have several variants of its components. These variants may be independent or be implemented in combination.

According to first variants concerning the opening 13 of the antenna 10, the opening 13 comprises an element semi-reflective (or semi-transparent) to electromagnetic waves. Thus, the electromagnetic waves can partially pass through these semi-reflective elements in the entry or exit direction of the housing 11, the non-transmitted part of these electromagnetic waves then being reflected towards the interior of the cavity to undergo one more or more further reflections. Optionally, these reflections within the cavity bring the electromagnetic wave to the tunable surface 30 which therefore controls a portion of it each time.

Optionally, the semi-reflective element is implemented by a thin metal film.

Optionally, the semi-reflective element is implemented by a network of holes in a metal element or a network of metal shapes, a hole or shape being distanced from a neighboring one by a distance that is less than half the wavelength of the electromagnetic wave.

Optionally, the semi-reflective element has an electromagnetic transmission property (i.e. transmittance) which varies within the internal surface of the opening 13. In other words, this electromagnetic transmission property is not constant within the opening 13 and some parts of the opening 13 allow more waves through than other parts. The electromagnetic transmission property comprises, for example, the transmission amplitude and/or the transmission phase through the semi-reflective element, depending on its material and/or its structural characteristics.

Optionally, the semi-reflective element comprises one or more adjustable opening elements adapted and controlled to modify the manner in which the electromagnetic wave is reflected and/or transmitted by this adjustable opening element, which makes it possible to actively modulate the transparency of the opening 13. The controller is then linked to the adjustable opening elements in order to control them based on opening parameters. These adjustable opening elements may be similar or different from the adjustable elements of the tunable surface 30. The opening parameters are different from the parameters of the tunable surface 30.

Figure 5A:
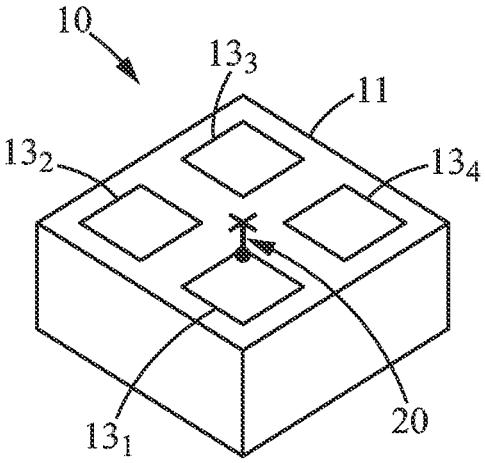
FIG. 5*a* is a schematic view of a variant of the antenna of FIG. 1, comprising an opening composed of several elementary openings on one face of the housing.
Figure 5B:
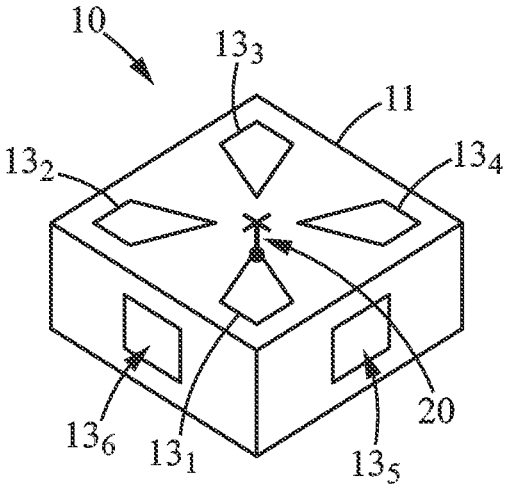
FIG. 5*b* is a schematic view of a variant of the antenna of FIG. 1, comprising an opening composed of several elementary openings on several faces of the housing.

Optionally, the opening 13 consists of several elementary openings 131 . . . 136 as shown in FIGS. 5*a* and 5*b*. These elementary openings are located on a single face of the housing 11 or on a plurality of faces of the housing 11. These elementary openings may or may not have identical shapes, whether on one face or on several faces of the housing 11.

According to second variants concerning the housing 11 of the antenna 10, the housing 11 has a parallelepipedal shape as shown in FIG. 1, or non-parallelepipedal. For example, the housing 11 may have a cylindrical or spherical shape or any other shape.

Optionally, the housing 11 comprises a main face which has the largest surface area of the faces of the housing. The main face optionally comprises the opening 13 or part of the opening 13 (at least one elementary opening).

The housing 11 then has a dimension in a direction perpendicular to the main face that is smaller than the other dimensions of the housing 11.

Optionally, the thickness dimension is greater than half the wavelength of the electromagnetic wave.

Figure 6:
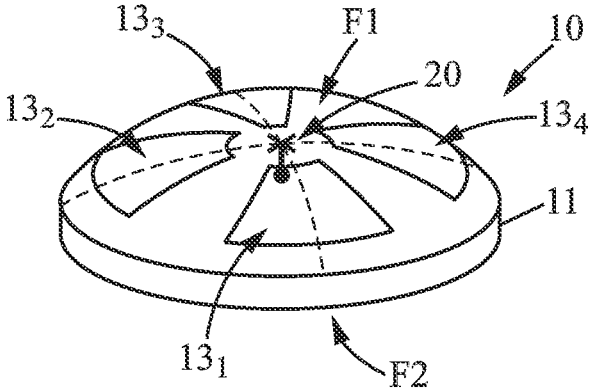
FIG. 6 is a schematic view of a variant of the antenna of FIG. 1, with a dome-shaped housing.

Optionally, the main face is semi-spherical in shape. This face may advantageously comprise the opening 13 so as to more easily offer a uniform radiation pattern in the horizontal plane over 360° around the normal to said main face. The housing 11 then has for example the shape of a dome as shown in FIG. 6, with a semispherical main face F1 for transmission/reception and a secondary face F2 in a direction opposite to the main face. The secondary face F2 is substantially flat and circular.

For example, the radiating element 20 is placed inside the housing 11 in the center of the main face F1, i.e. in this semi-spherical shape, and the tunable surface may be placed on the secondary face F2 opposite the radiating element 20. An opening 13 possibly composed of elementary openings are located on the main face F1, around the radiating element 20.

According to third variants concerning the radiating element 20 of the antenna 10, the radiating element 20 integrated in the housing 11 of the antenna 10 is itself directional, meaning it generates an electromagnetic wave beam We concentrated in one direction.

Optionally, the radiating element 20 is positioned in the housing 11 relative to the tunable surface 30 in such a way that it emits and/or receives an electromagnetic wave We primarily directly towards the tunable surface 30, by a predetermined orientation of the radiating element 20.

Optionally, the radiating element 20 is a monopole or a dipole or a waveguide or a radiating waveguide or a planar antenna. In fact, the integration of the radiating element 20 and tunable surface 30 in a cavity 12 makes it possible to use any type of radiating element.

Optionally, the radiating element 20 may be composed of a plurality of active elements. These active elements may be specialized: one or more of them are elements for emitting electromagnetic waves We, and one or more of them are elements for receiving electromagnetic waves.

The radiating element 20 may be specified for a particular wave frequency or several frequencies or a bandwidth between two frequencies.

Advantageously, the radiating element 20 is impedance matched with the impedance of the cavity 12, meaning the cavity including all its elements, for example the opening 12 and the tunable surface 30 and other elements. In particular, it is often desirable to satisfy a critical coupling condition for this impedance matching. The quality factor of the radiating element 20 and cavity 12 are similar or identical.

According to fourth variants concerning the tunable surface 30, this tunable surface 30 covers all the faces or interior surfaces of the housing 11. Optionally, it covers only a portion of the faces or interior surfaces of the housing 11. Optionally, the tunable surface 30 is inside the housing 11 (within its internal volume) and at a distance from its faces or surfaces.

Optionally, the tunable surface 30 consists of adjustable elements 31 distributed within the housing 11 without periodicity. In other words, they do not form a regular matrix. In fact, they may almost be distributed randomly or at determined locations for any given purpose. Great freedom is allowed. This possibility is not possible in the phase array or reflectarray antennas of the prior art which either need periodicity or bringing the elements together into a restricted area to illuminate them.

Optionally, the tunable surface 30 may comprise first adjustable elements tuned to a first frequency and second adjustable elements tuned to a second frequency. The first frequency is different from the second frequency.

Above all, these first and second adjustable elements may be spatially intermixed inside the cavity, while in prior art antennas this possibility is impossible due to the operating constraints on the distance between the adjustable elements for these antennas.

In particular, for satellite applications, it is possible to have a compact antenna adapted for two frequencies such as a first frequency of 20 GHz for transmission and a second frequency of 30 GHz for reception.

The tunable surface 20 comprises both types of adjustable elements distributed within the cavity of the housing.

Optionally, the tunable surface 30 comprises adjustable elements tuned to a plurality of different frequencies within a predetermined bandwidth so that the antenna can operate within the entire bandwidth.

Optionally, the tunable surface 30 may be controlled to obtain selected polarizations of the electromagnetic wave Wa. In particular, it is possible to obtain with the tunable surface 30 a horizontal polarization, a vertical polarization, or any combination of horizontal and vertical polarization, and therefore a circular polarization.

The controller 40 can thus also determine the parameters according to a desired polarization, whether horizontal, vertical, or circular.

Figure 7:
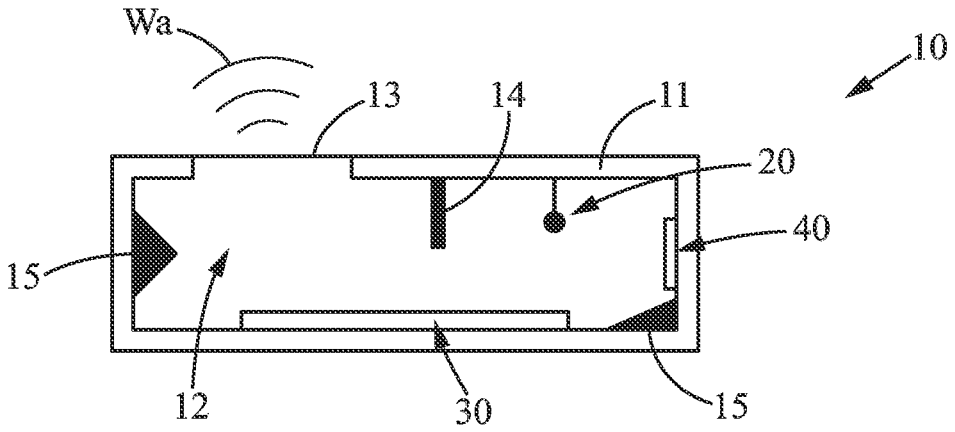
FIG. 7 is a sectional side view of an antenna according to FIG. 1, including a screen and reverberant devices.

According to fifth variants, the antenna 10 may comprise other elements in the cavity, such as one or more protective screens 14 or one or more reverberating devices 15 or internal walls, as shown in FIG. 7.

A screen 14 may advantageously be positioned in the cavity 12 between the radiating element and the opening 13, to limit direct radiation of the electromagnetic wave from the radiating element 20 to outside the housing and/or to reflect the waves toward the tunable surface 30.

A reverberant device 15 may also be positioned in the cavity 12, to make the reflections of electromagnetic waves in the cavity 12 more complex.

These arrangements ensure that the waves We are reflected one or more times inside the cavity 12 of the antenna 10, which ensures that they strike the tunable surface 30 at least once, and preferably several times over a plurality of adjustable elements 31.

Optionally, there are internal walls inside the housing 11 and dividing the cavity 12 into a plurality of compartments. The tunable surface 30 or part of the tunable surface, i.e. adjustable elements 31, may be placed on these internal walls.

The antenna 10 may also comprise, in the cavity 12, one or more internal sensors capable of receiving the electromagnetic wave. These internal sensors generate feedback signals which are measurements or values of the electromagnetic wave received by the internal sensors at certain predetermined periods.

The controller 40 then determines the parameters of the tunable surface 30 based the desired direction, as before, but also on these values of the internal sensors.

These internal sensors allow the antenna 10 to lastingly retain its characteristics of directivity and tilt precision of the electromagnetic wave. The antenna 10 is thus more robust to temporal variations and to external interference.

Figure 8:
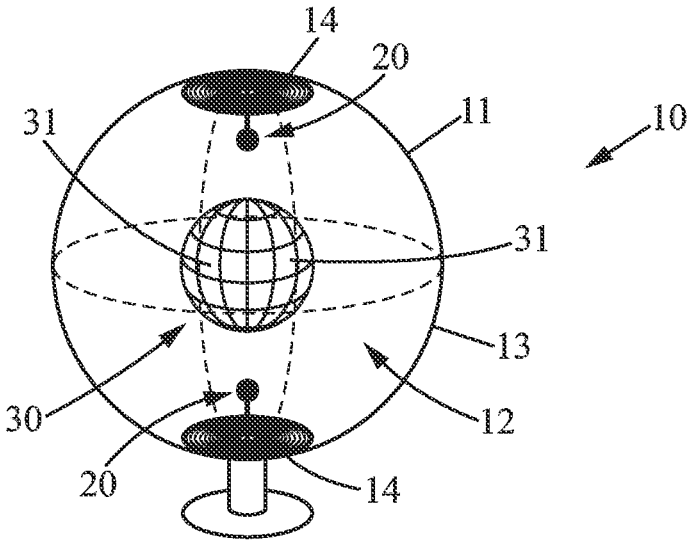
FIG. 8 shows a second embodiment of a spherical antenna.

FIG. 8 shows a second embodiment of the invention of an antenna 10 according to the invention. This antenna comprises the same elements as the antenna 10 of the first embodiment, and can have the same variants independently of one another or in combination.

This antenna 10 has a spherical housing 11 and a spherical tunable surface 20 of smaller diameter than that of the housing, said tunable surface 20 being positioned inside and at the center of the housing 11. The housing 11 comprises a very large opening 13 over almost the entire surface of the housing. In fact, as already explained, the opening 13 is defined in the electromagnetic sense; in other words it is a part of the housing which is transparent to or semi-reflective of the electromagnetic waves so that these waves can enter and/or leave the housing 11. It is sufficient for this opening to consist of a material having this property. In the present case, the opening 13 is advantageously semi-reflective so that the electromagnetic waves are reflected several times between the tunable surface 30 and the housing 11 before exiting the housing 11 or reaching the radiating element 20.

The radiating element 20 is for example located near the internal surface of the housing 11. Advantageously, this radiating element 20 is protected from the outside by a screen 15: the housing 11 is reflective behind the radiating element.

With these arrangements, the antenna 10 of this embodiment is capable of transmitting and/or receiving electromagnetic waves over 360° and even in any spatial direction.

As shown, the antenna 10 may comprise two or more radiating elements 20, which improves its angular capabilities.

Finally, upon reading this detailed description, those skilled in the art will understand that many numerous variants of a steerable antenna are possible, concerning the shape, frequencies, or directivity performance, depending on each application.

Many applications in communication transmissions and radar detection are possible.

For example, in radio communication, such antennas having high capabilities for steering the electromagnetic wave beam, could be used in pairs. The antennas could be able to self-adjust their directivity in order to direct their beams towards each other and greatly improve the quality and bandwidth of the transmission between the two antennas.

For example, the antenna technology according to the invention may be of great interest in satellite antenna applications due to its compactness and its multi-frequency capabilities.

The invention claimed is:

1. Antenna for transmitting and/or receiving an electromagnetic wave in a desired direction, comprising:

a radiating element for emitting and/or receiving said electromagnetic wave, a tunable surface comprising a plurality of elements that are adjustable in order to modify an impedance of said tunable surface and to change the manner in which the electromagnetic wave is reflected by said tunable surface, and a controller connected to the tunable surface and which controls the adjustable elements thereof based on parameters, said parameters being determined based on the desired direction of the electromagnetic wave, wherein the radiating element and the tunable surface are integrated inside a housing, said housing forming a cavity adapted so that the electromagnetic wave is reflected several times inside the housing in order to strike the adjustable elements of the tunable surface several times, said housing comprising an opening for the electromagnetic wave to be transmitted to outside the housing or be received from outside the housing, through said opening, and to/from the far field.

2. The antenna according to claim 1, further comprising a screen positioned in the cavity between the radiating element and the opening, to limit direct radiation of the electromagnetic wave from the radiating element to outside the housing and/or to reflect the waves towards the tunable surface.

3. The antenna according to claim 1, wherein the opening consists of several elementary openings, these elementary openings being on one face of the housing or on a plurality of faces of the housing.

4. The antenna according to claim 1, wherein the opening at least partially consists of one or more semi-reflective elements.

5. The antenna according to claim 4, wherein the semi-reflective element is implemented by a thin metal film.

6. The antenna according to claim 4, wherein the semi-reflective element is implemented by a network of holes in a metal element or a network of metal shapes, a hole or shape being distanced from a neighboring one by a distance that is less than half the wavelength of the electromagnetic wave.

7. The antenna according to claim 4, wherein the semi-reflective element has an electromagnetic transmission property which varies within the surface of the opening.

8. The antenna according to claim 7, wherein the electromagnetic transmission property comprises the transmission amplitude and/or the transmission phase.

9. The antenna according to claim 1, wherein the semi-reflective element comprises one or more adjustable opening elements in order to change the manner in which the electromagnetic wave is reflected and/or transmitted by said opening, the controller being linked to the adjustable opening elements in order to control them based on opening parameters.

10. The antenna according to claim 1, wherein the radiating element is positioned in the housing so as to emit and/or receive an electromagnetic wave primarily directly towards the tunable surface, by orientation of said element within the housing.

11. The antenna according to claim 1, wherein the radiating element is impedance matched with the impedance of the cavity, in order to satisfy a critical coupling condition.

12. The antenna according to claim 1, wherein the radiating element is selected from a list comprising a monopole, a dipole, a waveguide, a radiating waveguide, and a planar antenna.

13. The antenna according to claim 1, wherein the tunable surface covers all the inside faces of the housing or a portion of the inside faces of the housing or one or more of the inside faces of the housing.

14. The antenna according to claim 1, wherein the tunable surface consists of adjustable elements distributed within the housing without periodicity.

15. The antenna according to claim 1, wherein the tunable surface comprises first adjustable elements tuned to a first frequency and second adjustable elements tuned to a second frequency, the first frequency being different from the second frequency.

16. The antenna according to claim 15, wherein the first and second adjustable elements are distributed and are spatially intermixed.

17. The antenna according to claim 1, wherein the tunable surface comprises adjustable elements tuned to a plurality of different frequencies within a predetermined bandwidth.

18. The antenna according to claim 1, wherein the housing comprises a main face, and wherein the housing has a thickness dimension in a direction perpendicular to said main face that is smaller than the other dimensions of the housing, and the thickness dimension is greater than half the wavelength of the electromagnetic wave.

19. The antenna according to claim 1, wherein the housing comprises a main face, and wherein the main face is semi-spherical in shape.

20. The antenna according to claim 1, wherein the controller determines the parameters also as a function of a desired polarization.

21. The antenna according to claim 1, wherein the controller determines the parameters based on parameter values previously stored in a memory, or by calculating a model, or by an iterative process using additional information.

22. The antenna according to claim 21, wherein the additional information is obtained from signals from external sensors located outside the housing and capable of receiving the electromagnetic wave.

23. The antenna according to claim 1, further comprising one or more internal sensors capable of receiving the electromagnetic wave, said internal sensors being integrated inside the housing, and the controller determines the parameters based on a desired direction of the electromagnetic wave and on values of the electromagnetic wave received by the internal sensors at certain predetermined periods.

24. The antenna according to claim 1, comprising a plurality of radiating elements integrated inside the housing.

25. Radio communication system capable of communicating communications of audio, video, messages, or data, said radio communication system comprising an antenna according to claim 1.

26. Radar detection system suitable for locating objects within a space, said radar detection system comprising an antenna according to claim 1.

* * * * *